United States Patent [19]

Butterworth

[11] 4,182,943

[45] Jan. 8, 1980

[54] PUSH BUTTON DEVICE

[75] Inventor: Edmund M. Butterworth, Bedford, England

[73] Assignee: Eaton Corporation, Cleveland, Ohio

[21] Appl. No.: 910,621

[22] Filed: May 30, 1978

[30] Foreign Application Priority Data

Jun. 17, 1977 [GB] United Kingdom ..... 25511/77

[51] Int. Cl.[2] ..... H01H 3/12

[52] U.S. Cl. ..... 200/159 R; 200/328

[58] Field of Search ..... 200/323, 325, 328, 159 R, 200/340

[56] References Cited

U.S. PATENT DOCUMENTS

| | | | |
|---|---|---|---|
| Re. 26,845 | 3/1970 | Koepke | 200/325 |
| 2,249,375 | 7/1941 | Day | 200/159 R |
| 2,523,125 | 9/1950 | Ley | 200/340 |

FOREIGN PATENT DOCUMENTS

| | | | |
|---|---|---|---|
| 288944 | 4/1967 | Australia | 200/328 |
| 2263762 | 7/1974 | Fed. Rep. of Germany | 200/340 |

*Primary Examiner*—Steven L. Stephan

*Attorney, Agent, or Firm*—Hugh R. Rather; William A. Autio

[57] ABSTRACT

A push-button device for controlling electrical apparatus comprises a push-button head which is manually depressible against a resilient bias and which becomes latched in its depressed position, the push-button head being releasable from its depressed position and returning to its normal position in response to a turning movement applied either directly to the push-button head itself or to a key when inserted in a lock incorporated in the push-button head.

12 Claims, 4 Drawing Figures

PUSH BUTTON DEVICE

FIELD OF THE INVENTION

This invention relates to a push-button device for controlling electrical apparatus.

BACKGROUND OF THE INVENTION

Push-button devices are known but the object of this invention is to provide a simple push-button device which latches in its depressed position and then can be easily and quickly released and returned to its normal, undepressed position.

SUMMARY OF THE INVENTION

In accordance with the present invention, there is provided a push-button device for controlling electrical apparatus, comprising a push-button head which is manually depressible against a resilient bias and which becomes locked in its depressed position, the push-button head being releasable from its depressed position and returning to its normal position in response to a turning movement. In one or two embodiments to be described herein, the push-button is released by turning the head through a small angle, whereupon a spring bias returns the push-button to its rest position. In the other embodiment, the head incorporates a lock mechanism and is released by a key.

Each embodiment includes a latching spring the bias of which is such that the spring moves into a detent when the push-button is depressed, thereafter retaining the push-button in that position: the push-button is released, to return to its normal position, upon moving the latching spring from the detent. Such spring, in each embodiment, is of a scissor-type, and is carried by the push-button: it comprises two limbs extending generally parallel to the axis of movement of the push-button, the free ends of the respective limbs being biased radially outwards to latch, upon depression of the button, into detents in a fixed part of the device. In the one embodiment, when the push-button head is turned, the free ends of the latching spring slide over cams provided on the fixed part, adjacent the detents, to be displaced sufficiently far in the radially inwards direction. In the other embodiment, the key, upon turning, rotates a camming member which encircles the latching spring and this camming member acts on the limbs to move the limbs of the latching spring radially inwards until the free ends are displaced from their detents.

Embodiments of this invention will now be described, by way of examples only, with reference to the accompanying drawings, in which.

Figure 1:
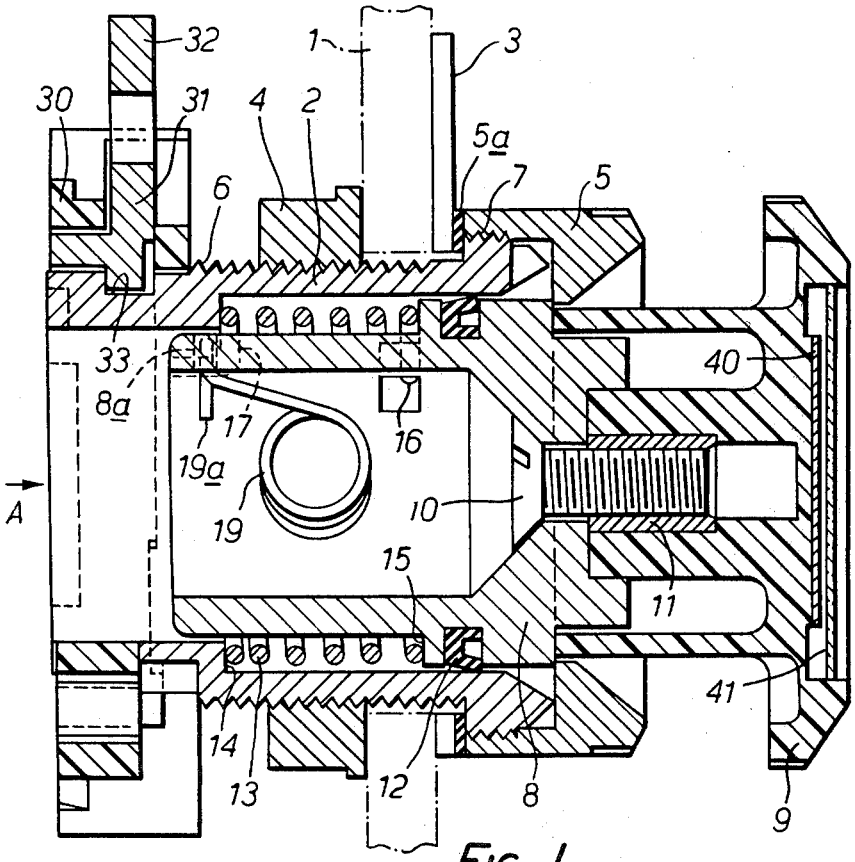
FIG. 1 is a longitudinal section through one embodiment of push-button device for controlling electrical apparatus, shown mounted on a panel.
Figure 2:
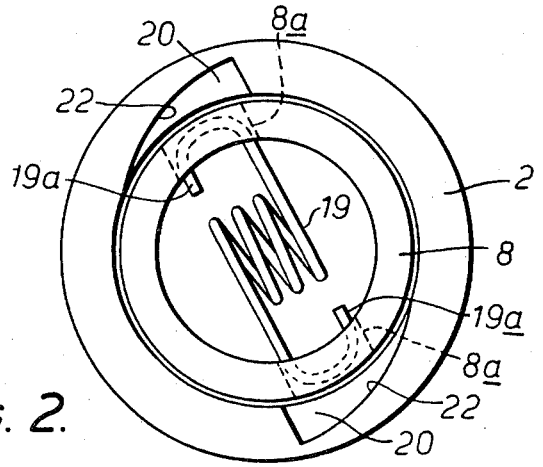
FIG. 2 is a rear view of the device, in the direction of arrow A in FIG. 1.

Referring to FIGS. 1 and 2, there is shown a push-button device mounted on a panel 1. The device comprises a tubular body member 2 which extends through a circular aperture in the panel and through a corresponding aperture in a name plate 3 disposed on the front surface of the panel. The member 2 is secured to the panel by a ring nut 4, which is provided internally with screw threads and which is engaged upon external threaded surface 6, on the member 2, the panel 1 and name plate 3 being clamped between the ring nut 4 and a bezel 5 which is threadedly engaged with, and locked with adhesive to, the member 2 at 7 with the interposition of a sealing washer 5*a*.

A push-button body 8 is slidably guided within the tubular member 2 and a push-button head 9, of generally mushroom shape, is secured to the forward end of push-button body 8 by means of a screw 10 which extends through an aperture in the push-button body 8 and is threadedly engaged within a metal insert 11 carried in a bore in the push-button head 9. An oil seal 12 is housed in an annular groove in the outer surface of the push-button body 8. A helical torsion spring 13 is disposed in an annular space between the push-button body 8 and the tubular member 2 and acts between respective annular shoulders 14,15 on these two members to urge the push-button outwards from the panel. Also, the spring 13 has opposite ends 16,17 located in detents formed in the tubular member 2 and push-button body 8, so as to bias the latter to a particular angular orientation relative to tubular member 2.

The push-button body 8 is formed with a large axial bore housing a scissor-type spring 19. This comprises 2½ helical turns with two elongate limbs extending from opposite ends of the helical portion: these limbs extend generally axially of the push-button body 8 but diverge slightly towards their ends remote from the helical portion; the free ends of these limbs are bent radially outwards of the push-button body and are hooked, as at 19*a* and the hooked end portions extend through circumferential slots 8*a* in the push-button body. Slots 8*a* are only slightly longer, in the circumferential direction, than the width of the hooked end portions 19*a*.

The tubular member 2, adjacent its inner end and in its inner surface, is provided with a pair of diametrically opposed detents 20 and with associated cam surfaces 22. In use, electrical contact apparatus is secured to this inner end of the tubular member 2 and includes an element arranged to be moved by the inner end of the push-button body 8 upon depression of the push-button. A mounting ring 30 is shown, which in use is secured to the forward end of the electrical contact apparatus: this ring 30 incorporates a locking ring 31 which may be turned by an integral radially projecting lever 32 so that lugs on its inner circumference engage in bayonet-type grooves 33 on the tubular member 2 to lock the contact apparatus to the tubular member 2.

A label 40, having a legend thereon, is applied to the top of the push button head and is covered by a transparent plastics plate 41 have two diametrically opposite projections engageable in slots in the rim of the head, so that the plate and the label are removable.

In operation, the push-button will be retained in its depressed position because, upon reaching this position, the hooked ends 19*a* of the spring 19 will move into the detents 20 under the biassing effect of this spring. The push-button is released only by turning the head 9 through a small angle: this rotation carries the push-button body 8 and with it the spring 19, so that the hooked-ends 19*a* of the latter, camming upon surfaces 22, are moved sufficiently far radially inwards (against the bias of spring 19) as to withdraw from the detents 20. The torsion spring 13 then returns the push-button to its normal (i.e. non-depressed) position, at the same time biassing the push-button button to its normal angular position by an annular cam gradient in 8 engaging a locating pip in 2.

Figure 3:
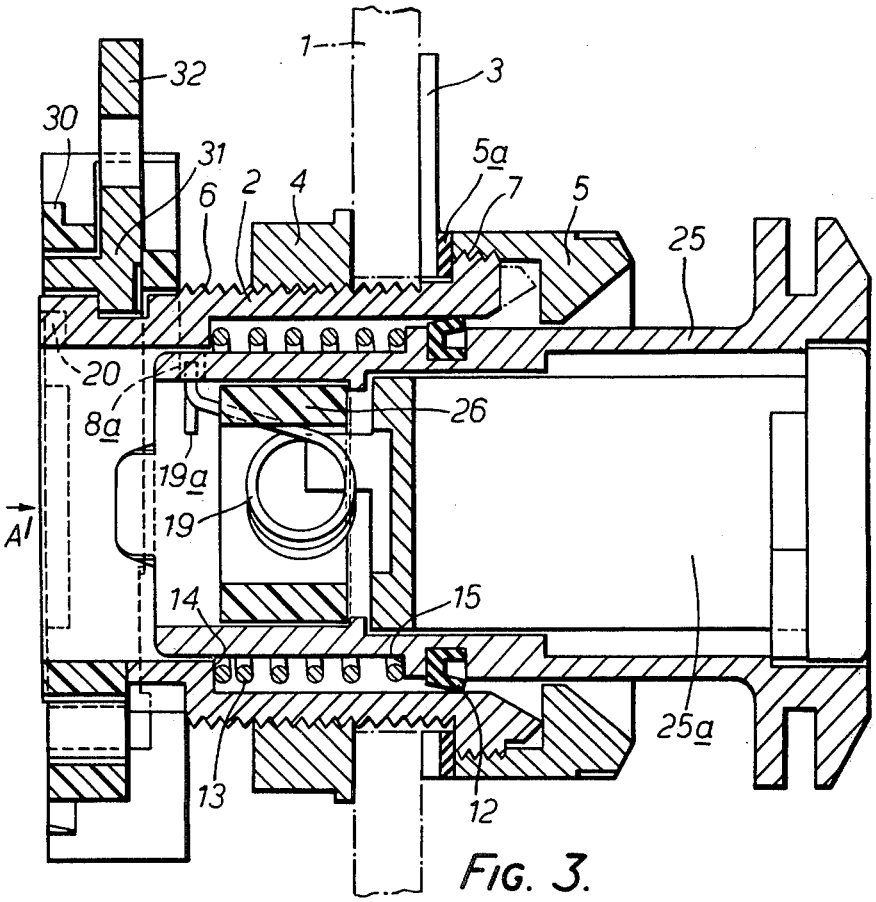
FIG. 3 is a longitudinal section, similar to that of FIG. 1, through another embodiment of push-button device.
Figure 4:
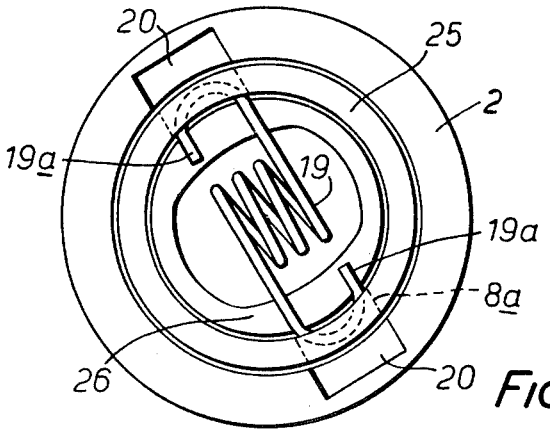
FIG. 4 is a rear view of the FIG. 3 device, in the direction of arrow A' therein.

Referring now to FIGS. 3 and 4, there is shown a modified device, with parts similar to those of the device of FIGS. 1 and 2 denoted by like reference numerals. Instead of a push-button body and separate head, an integral push-button 25 is provided and a cylinder type lock 25*a* is incorporated therein, and arranged upon turning to rotate a camming member 26 which is disposed around the limbs of the latching spring 19. The push-button is automatically self-retaining in the depressed position, but is released by inserting a key in the head of the push-button and turning this key: thereupon, the camming member 26 (comprising a cylindrical outer surface journalled in the bore of the push-button body and an inner, elliptical surface) acts upon the limbs of spring 19 to move these limbs together and retract the hooked ends thereof from the detents 20.

In the embodiments shown, components 2,4,5,8,9, 25 and 26 comprise plastics or die cast mouldings.

What is claimed is:

1. A push-button device for controlling electrical apparatus, said push-button device comprising:

mounting means;

a push-button head mounted in said mounting means and movable along an axis between a normal position and a depressed position;

biasing means for biasing said push-button head toward said normal position, whereby said push-button head is manually depressible from its normal position to its depressed position;

detent means formed on said mounting means;

a latching spring carried by said push-button head, said latching spring having portions biased outwardly of said push-button head to engage said detent means upon depression of said push-button head to latch the latter in its depressed position;

and said push-button head including manually turnable means for retracting said latching spring to cause said push-button head to be returned to its normal position by said biasing means.

2. A push-button device as claimed in claim 1, in which said latching spring comprises:

a helical portion, the opposite ends of which extend as two limbs generally parallel to said axis and having respective free ends biased apart;

said free ends registering with said detent means upon depression of said push-button head and said turnable means serving to retract said free ends from said detent means.

3. A push-button device as claimed in claim 2, in which the free ends of the limbs are bent radially outwards in opposite directions away from said axis.

4. A push-button device as claimed in claim 2, in which the free ends of the limbs are hooked.

5. A push-button device as claimed in claim 2, in which the push-button head comprises a body portion housing said latching spring, said body portion having two apertures through which the free ends of said limbs extend.

6. A push-button device for controlling electrical apparatus, said push-button device comprising:

fixed mounting means including a tubular portion;

a push-button head having a tubular portion mounted in said tubular portion of the mounting means;

said push-button head being movable along the common axis of said tubular portions between a normal position and a depressed position;

biassing means for biassing the push-button head towards said normal position, whereby said push-button head is manually depressible from its normal position to its depressed position;

latching means for latching the push-button head in its depressed position upon being depressed thereto, said latching means comprising a latching spring carried by said push-button head and having two limbs extending generally parallel to said axis and having respective free ends biassed apart, and two detents on said mounting means tubular portion with which said free ends register upon depression of said push-button head;

and the push-button head including manually turnable means to retract the free ends of the latching spring from said detents to cause the push-button head to be returned to its normal position by the biassing means.

7. A push-button device as claimed in claim 6, in which said tubular portion of the push-button is provided with two apertures through which said free ends of the latching spring extend and in which said detents are formed in the inner surface of said mounting means tubular portion.

8. A push-button device as claimed in claim 6, in which said detents are provided with cam surfaces for moving the free ends of the latching spring radially inwards towards said axis and out of the detents upon rotation of said tubular portion of the push-button head relative to the fixed mounting means.

9. A push-button device as claimed in claim 8, in which the tubular portion of the push-button head is integral with the push-button head itself so as to rotate with the push-button head as the latter is subjected to a manual turning movement.

10. A push-button device as claimed in claim 6, comprising a camming member arranged to act, in response to a manual turning movement, upon the limbs of the latching spring so as to move the limbs together whereby the free ends thereof are withdrawn from their said detents.

11. A push-button device as claimed in claim 10, in which said camming member comprises a ring having a cylindrical outer surface and an elliptical inner surface, said outer surface being journalled within the cylindrical inner surface of the push-button tubular portion, said camming member being rotated relative to the push-button tubular portion to act upon the latching spring limbs as aforesaid.

12. A push-button device as claimed in claim 10, in which the push-button head incorporates a cylindrical lock for receiving a key to which a turning movement is applied, said lock being coupled to said camming member so as to rotate the latter when the key is turned in the lock.

* * * * *